United States Patent [19]
Burrahm

[11] Patent Number: 4,907,544
[45] Date of Patent: Mar. 13, 1990

[54] TURBOCHARGED TWO-STROKE INTERNAL COMBUSTION ENGINE WITH FOUR-STROKE CAPABILITY

[75] Inventor: Robert W. Burrahm, San Antonio, Tex.

[73] Assignee: Southwest Research Institute, San Antonio, Tex.

[21] Appl. No.: 334,449

[22] Filed: Apr. 6, 1989

[51] Int. Cl.[4] ..... F02B 19/02
[52] U.S. Cl. ..... 123/26; 123/65 A; 123/65 VD; 123/DIG. 7
[58] Field of Search ..... 123/65 A, 65 B, 65 BA, 123/65 VD, 26, DIG. 7, 308, 432, 84

[56] References Cited

U.S. PATENT DOCUMENTS

| | | | |
|---|---|---|---|
| 877,753 | 1/1908 | Ash . | |
| 1,077,363 | 11/1913 | Nash . | |
| 1,122,127 | 12/1914 | Kemptner . | |
| 1,792,028 | 2/1931 | Peterson | 123/21 |
| 1,814,676 | 7/1931 | Estep . | |
| 1,892,124 | 12/1932 | Abell | 123/65 BA |
| 1,963,780 | 6/1934 | DuBois | 123/65 BA |
| 2,178,152 | 10/1939 | Walker | 123/321 |
| 2,304,407 | 12/1942 | Hogan . | |
| 2,633,110 | 3/1953 | Parsons . | |
| 2,780,912 | 2/1957 | Miller . | |
| 2,865,164 | 12/1958 | Kauffmann . | |
| 4,070,998 | 1/1978 | Grow | 123/26 |
| 4,224,905 | 9/1980 | von Seggern et al. | 123/65 VC |
| 4,392,459 | 7/1983 | Chareire | 123/21 |
| 4,660,383 | 4/1987 | Leonard | 123/26 |
| 4,660,513 | 4/1987 | Figliuzzi | 123/65 VD |
| 4,827,882 | 5/1989 | Paul et al. | 123/78 AA |

*Primary Examiner*—David A. Okonsky
*Attorney, Agent, or Firm*—Cox & Smith

[57] ABSTRACT

A two-stroke cycle internal combustion engine without crankcase scavenging is disclosed which is able to operate in a four-stroke mode at cranking and idle speeds. The engine utilizes a turbocharger driven by exhaust gases to recharge the cylinder with fresh air or an air/fuel mixture. An auxiliary inlet valve responsive to pressure within the cylinder enables the engine to operate in a four-stroke mode, thus eliminating the need for an externally driven air pump when the engine is either idling, being started, or under light loads where turbocharger boost is too low to supply sufficient flow of air or an air/fuel mixture.

6 Claims, 1 Drawing Sheet

TURBOCHARGED TWO-STROKE INTERNAL COMBUSTION ENGINE WITH FOUR-STROKE CAPABILITY

BACKGROUND OF THE INVENTION

The present invention relates to a turbocharged two-stroke cycle internal combustion engine which can operate in a four-stroke mode under idling or starting conditions in order to eliminate the need for an externally driven air pump.

A two-stroke cycle internal combustion engine, in which a cycle consists of a power stroke and a compression stroke each occurring once during each revolution of the crankshaft, produces more power at a given rate of engine speed than a four-stroke cycle engine. This is because in a four-stroke cycle, a power stroke only occurs once very other revolution of the crankshaft. Under a condition of reduced load, however, the four-stroke cycle is more efficient at a given engine speed since less fuel is consumed. It would be advantageous, therefore, for a two-stroke cycle engine to have the capability of shifting to a four-stroke cycle mode in these situations.

In a two-stroke cycle, the exhaust valve must open once during each revolution of the crankshaft toward the end of the power stroke. An inlet valve or port must also open at around the same time to charge the cylinder with fresh air or an air/fuel mixture and displace the burned exhaust gases. A four-stroke cycle, on the other hand, consists of intake, compression, power, and exhaust strokes. The exhaust valve must open on every other revolution of the crankshaft during the exhaust stroke. The intake valve must also open on every other crankshaft revolution during the intake stroke.

Numerous methods exist in the prior art for enabling an engine to operate in both two and four stroke cycle modes. For example, if crankcase scavenging (explained below) is utilized for two-stroke operation, another port connecting the crankcase with the cylinder must open during the power stroke while the intake valve used in four-stroke operation must remain permanently closed. Or, if no crankcase scavenging is used, a supercharger or air pump forces a fresh charge through a port in the wall of the cylinder which is uncovered by the piston when it reaches bottom dead center, the four-stroke intake valve again being permanently closed. Alternatively, the four-stroke intake valve port may be used by the air pump during two-stroke operation. With any of these engine types, in order to go from two-stroke to four-stroke operation, means must be employed to cause the inlet and exhaust valves to open at appropriate times once every other crankshaft revolution. U.S. Pat. Nos. 2,178,152 and 1,792,028 disclose methods employing two sets of cams with mechanical means for switching between them. U.S. Pat. No. 4,392,459 discloses a method utilizing a computer to control the operation of the valves. All of these methods are somewhat complex which decreases the reliability and increases the cost of the engine. It would be advantageous if the operation of an engine could be shifted from four-stroke to two-stroke or vice versa simply by changing the speed of the camshaft which opens and closes the exhaust valve.

Two-stroke cycle engines may or may not utilize crankcase scavenging. Crankcase scavenging means that the crankcase is used to receive fresh charges of air/fuel mixture when the piston moves upward in the compression stroke. During the power stroke, a flow passage is established between the cylinder and the crankcase, and the inlet port of the crankcase is closed. Thus, the air/fuel mixture in the crankcase is forced into the cylinder by increased pressure and displaces the burned exhaust gases which exit through an exhaust port.

When crankcase scavenging is utilized, however, it is not possible to have an appreciable volume of oil in the crankcase as in an ordinary four-stroke engine as it would be incompatible with two-stroke operation. Instead, oil must be circulated through passageways in order to effect the lubrication function, or the oil is simply mixed with the fuel.

It is advantageous, therefore, for a two-stroke cycle engine to operate without crankcase scavenging. A two-stroke cycle engine without crankcase scavenging, however, must have some means for removing burned exhaust gases from the cylinder and recharging it with either air or an air/fuel mixture since the movement of the piston is not able to perform this function as with crankcase scavenging. One such means is an air pump driven externally. A more efficient means is a turbocharger in which is incorporated a turbine driven by the exhaust gases. Even turbocharged two-stroke engines, however, must have an externally driven air pump to supply air or an air/fuel mixture when the engine is started or idled due to the low speeds in such situations which do not produce sufficient exhaust pressure to drive the turbine. The requirement of an air pump in this application necessarily increases manufacturing costs. It would be advantageous, therefore, for a turbocharged two-stroke cycle engine to be able to be started or idled without the need for an externally driven air pump.

SUMMARY OF THE INVENTION

It is an object of the present invention to provide a two-stroke engine which is capable of operating in a four-stroke mode in light load situations simply by changing the speed of the camshaft.

It is a further object of the present invention to provide a turbocharged two-stroke engine that does not utilize crankcase scavenging but does not require an externally driven air pump when the engine is either started or idled.

The present invention is a turbocharged two-stroke cycle engine without crankcase scavenging. Inlet ports located in the cylinder wall allow intake of a combustible gas (either an air/fuel mixture or fresh air in the case of a fuel injected engine) from the turbocharger. The turbine of the turbocharger is driven by exhaust gas exiting from a cam-operated exhaust valve. The cam is mounted on a camshaft which is driven by the crankshaft through a planetary gear arrangement so as to rotate at the same speed as the crankshaft. The pressure developed by the turbocharger is great enough to both force fresh air or air/fuel mixture into the cylinder and displace the previously burned exhaust gases which thus enables two-stroke operation without crankcase scavenging.

The present invention employs an auxiliary inlet valve to enable the engine to operate in a four-stroke mode when the engine is started, idled, or operated under light load conditions. Four-stroke operation is necessary during these conditions because the turbocharger cannot supply enough air or air/fuel mixture to the cylinder to support combustion. This is due to insufficient exhaust gas being available to drive the turbocharger turbine. The auxiliary inlet valve is responsive to pressure within the cylinder, opening when the pressure drops below a certain value and staying closed otherwise. By halving the speed of the camshaft, so that the exhaust valve opens during every other piston cycle, and in conjunction with the auxiliary intake valve, four-stroke operation is achieved. When sufficient exhaust gas flow is available to drive the turbocharger, conversion back to the two-stroke mode of operation is possible.

BRIEF DESCRIPTION OF THE DRAWING

The figure depicts a cross-sectional view of a representative piston and cylinder arrangement in accordance with the present invention.

DETAILED DESCRIPTION OF THE PREFERRED EMBODIMENT

Figure 1:
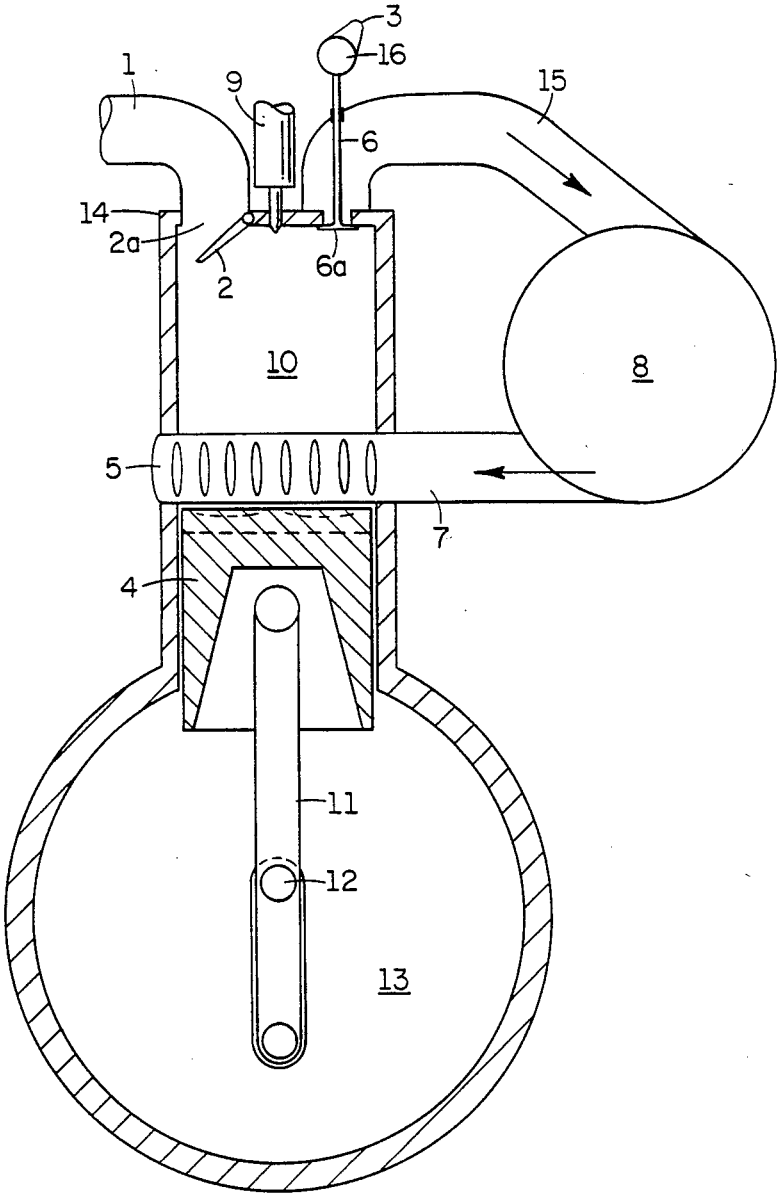

A cross section of a single cylinder of the engine in accordance with the present invention is depicted in the figure. The engine may be constructed with any number of cylinders all operating in substantially the same manner.

Referring to the figure, a piston 4 is movably mounted within a cylinder 10. A connecting rod 11 is rotatably connected to both the piston 4 and a crankshaft 12 located within the crankcase 13, enabling the reciprocating piston to rotate the crankshaft. Within the head 14 of the cylinder 10 are an auxiliary intake port 2*a*, an exhaust port 6*a*, and a spark plug 9. A cam operate exhaust valve 6 is seated within exhaust port 6*a*. Auxiliary intake port 2*a* is opened and closed by means of auxiliary intake valve 2 which is a reed-type valve, responsive to the pressure differential within auxiliary inlet pipe 1 and the interior of the cylinder. Within the sidewalls of the cylinder 10 are a plurality of intake ports 5 connecting the interior of the cylinder with an inlet pipe 7.

The normal two-stroke operation of the engine will now be described consisting of a power stroke and a compression stroke. Exhaust valve 6 is driven by a cam 3 mounted on camshaft 16 driven at the same speed as crankshaft 12 and in proper phase relationship by a planetary gear arrangement not shown in the figure. Camshaft 16 also actuates spark plug 9 at the proper phase and frequency by another cam means not shown. Starting from when the piston 4 has reached its uppermost point of travel (top dead center), the cylinder 10 contains an explosive mixture of air and fuel under pressure. Auxiliary intake valve 2 is maintained in the closed position by the pressure within the cylinder. Exhaust valve 6 is maintained in the closed position by cam 3. After spark plug 9 ignites the mixture, the power stroke begins as piston 4 is forced downward and imparts torque to crankshaft 12. Cam 3 operates so as to open exhaust valve 6 toward the end of the downward stroke. When the piston reaches its lowest point of travel (bottom dead center), an air/fuel mixture is forced into the cylinder from a carburetion source (not shown) by turbocharger 8 through inlet pipe 7 and inlet ports 5. Turbocharger 8 is driven by the exhaust gases flowing out exhaust port 6*a*, into exhaust pipe 15 and thence to the turbine of turbocharger 8. The air/fuel mixture flowing into the cylinder through inlet ports 5 both charges the cylinder with an explosive mixture and displaces any remaining exhaust gases which exit through exhaust port 6*a*. The compression stroke begins as piston 4 next moves upward. Intake ports 5 are closed by the piston, thus preventing any backflow of the newly received charge through ports 5. As piston 4 continues toward top dead center, the air/fuel mixture is compressed in preparation for the next power stroke. Cam 3 closes exhaust valve 6 during this part of the cycle in order to maintain pressure during the compression stroke. When the piston 4 reaches top dead center, the cycle begins again. The pressure existing within the cylinder 10 has maintained auxiliary intake valve 2 in the closed position during all phases of the cycle. The camshaft on which is mounted cam 3 is driven by crankshaft 12 through a planetary gear arrangement at the same rate of speed as crankshaft 12. Thus, exhaust valve 6 opens once during each power stroke thus enabling exhaust gases to drive turbocharger 8, as well as enabling their removal from the cylinder in preparation for the next compression stroke.

In order to change to four-stroke mode, the camshaft 16 is made to rotate at half the crankshaft speed by shifting to another set of planetary gears coupling the rotation of the crankshaft to the camshaft. A dog clutch may be used for this purpose in order to maintain the proper phase relationship between piston motion and cam rotation as is appropriate for either four-stroke or two-stroke operation. U.S. Pat. No. 2,178,152 discloses such an arrangement and is hereby incorporated by reference. There is no need, however, to switch to another set of cams in the present invention. Only cam 3 is needed for actuating exhaust valve 6. Since the rotation of camshaft 16 also controls the operation of spark plug 9, all that is necessary to shift into four-stroke mode is to change the speed of camshaft.

In the four-stroke mode, the exhaust valve 6 remains closed during all of the power stroke. As the piston 4 next moves upward in the exhaust stroke, exhaust valve 6 opens allowing the exit of the burned gases. When the piston 4 reaches top dead center, the spark plug 9 does not fire as in two-stroke mode owing to the reduced speed of camshaft 16. As the piston 4 next moves downward to start the intake stroke, the pressure within cylinder 10 falls below the ambient pressure within auxiliary inlet pipe 1. Auxiliary intake valve 2, therefore, opens, allowing cylinder 10 to be charged with a fresh air/fuel mixture. Exhaust valve 6 remains closed throughout the intake stroke owing to the reduced speed of camshaft 10. As the piston 4 moves upward to begin the compression, auxiliary inlet valve closes because of increased pressure. When the piston 4 reaches top dead center, the compressed air/fuel mixture is ignited by spark plug 9 to begin the next power stroke.

The foregoing has described the invention as embodied in a gasoline-type internal combustion engine. The invention may also be embodied in a diesel-type internal combustion engine. In that case, the schematic representation of spark plug 9 should be regarded as a fuel injector actuated by camshaft 16. Also, the cylinder is charged with fresh air through auxiliary intake port 2*a* and intake ports 5 rather than an air/fuel mixture. In all other respects, the operation is the same as described above.

Although the invention has been described in conjunction with the foregoing specific embodiment, many alternatives, variations and modifications are apparent to those of ordinary skill in the art. Those alternatives, variations and modifications are intended to fall within the spirit and scope of the appended claims.

What is claimed is:

1. A two-stroke cycle internal combustion engine which can operate in a four-stroke mode, comprising:

a cylinder having sidewalls and a head with an exhaust port and an auxiliary intake port;

a piston movably mounted within the cylinder and operably connected to a crankshaft, the cylinder having an intake port sealed by the piston except when the piston nears bottom dead center;

an exhaust valve for opening and closing the exhaust port;

an auxiliary intake valve mounted within the auxiliary intake port and responsive to pressure within the cylinder, the valve opening the port as the pressure drops below a certain value and closing the port as the pressure rises above that value;

means connected to the exhaust port and driven by the exhaust pressure for forcing a combustible gas into the cylinder through the inlet port and displacing exhaust gases through the exhaust port; and means for opening and closing the exhaust valve in accordance with either four-stroke or two-stroke cycle operation.

2. The engine as set forth in claim 1 wherein the means for opening and closing the exhaust valve is a cam mounted on a camshaft rotated by the crankshaft at either the speed of the crankshaft or one-half that speed.

3. The engine as set forth in claim 1 wherein the combustible gas driving means is a turbocharger.

4. The engine as set forth in claim 1 wherein the auxiliary intake valve is a reed-type valve.

5. In a turbocharged two-stroke cycle internal combustion engine utilizing neither crankcase scavenging nor an externally driven air pump, means for starting and idling the engine, comprising:

auxiliary intake valves for each cylinder of the engine responsive to the pressure within the cylinder, the valves opening when the pressure drops below a certain value and closing otherwise; and means for changing the speed of a camshaft actuating an exhaust valve for each cylinder to values equal to the crankshaft speed and one-half the crankshaft speed.

6. In a turbocharged two-stroke internal combustion engine without crankcase scavenging and having means for operating the exhaust valves in accordance with either two-stroke or four-stroke operation, a means for enabling the intake of combustible gas into cylinders of the engine during four-stroke operation through a port in each cylinder from a combustible gas source, comprising a valve mounted on each port responsive to pressure within the cylinder.

* * * * *